US005577480A

United States Patent [19]

Gmelin et al.

[11] Patent Number: 5,577,480

[45] Date of Patent: Nov. 26, 1996

[54] FUEL INJECTION DEVICE

[75] Inventors: Karl Gmelin, Flein; Thomas Bursitzky, Vaihingen, both of Germany

[73] Assignee: Robert Bosch GmbH, Stuttgart, Germany

[21] Appl. No.: 296,637

[22] Filed: Aug. 26, 1994

[30] Foreign Application Priority Data

Sep. 22, 1993 [DE] Germany ..... 43 32 118.6

[51] Int. Cl.[6] ..... F02M 35/00

[52] U.S. Cl. ..... 123/470; 123/472

[58] Field of Search ..... 123/470, 468, 123/469, 456, 472

[56] References Cited

U.S. PATENT DOCUMENTS

| | | | |
|---|---|---|---|
| 4,844,036 | 7/1989 | Bassler | 123/470 |
| 4,857,003 | 8/1989 | Hafner | 123/470 |
| 4,950,171 | 8/1990 | Muzslay | 123/456 |
| 5,030,116 | 7/1991 | Sakai | 123/456 |
| 5,058,554 | 10/1991 | Takeda | 123/456 |
| 5,070,844 | 12/1991 | Daly | 123/456 |
| 5,131,857 | 7/1992 | Gmelin | 123/456 |
| 5,203,304 | 4/1993 | Hafner | 123/470 |

OTHER PUBLICATIONS

Bosch Technische Unterrichtung [Bosch Technical Information], Mono-Jetronic, First Edition, Jun. 1991, p. 16.

*Primary Examiner*—Carl S. Miller

*Attorney, Agent, or Firm*—Edwin E. Greigg; Ronald E. Greigg

[57] ABSTRACT

For reliable, secure contacting of a fuel injection valve, the valve has a guide bolt, which with its free end protrudes past free ends of the plug elements, so that prior to the insertion of the plug elements into corresponding receptacles, this guide bolt slides in a guide opening, so as to center the plug elements of the fuel injection valves. The invention is intended for contacting electromagnetically actuatable fuel injection valves for fuel injection devices.

12 Claims, 2 Drawing Sheets

FUEL INJECTION DEVICE

BACKGROUND OF THE INVENTION

The invention is based on a fuel injection device as defined hereinafter. A fuel injection device is already known (Bosch Technische Unterrichtung [Bosch Technical Information] Mono-Jetronic, First Edition, June 1991, page 16), in which an electromagnetically actuatable fuel injection valve is contacted by means of a top-mounted ring-shaped plug housing. Two plug elements of the fuel injection valve are used for that purpose; in the form of contact pins, they protrude from a valve housing end located upstream of an injection orifice of the fuel injection valve. When the plug housing is set on top, the plug elements are received by corresponding receptacles provided in the plug housing; the valve housing end is introduced partway into a recess of the plug housing.

When the fuel injection valve is mass-produced, however, the problem arises that in assembly, upon mounting of the plug housing on the fuel injection valve, the plug elements and receptacles do not reliably meet, or in other words by tilting because of the lack of adequate radial centering of the plug elements, they can bend inside the plug housing recess, and in the worst case do not enter the receptacles at all so that no electrical connection takes place. Yet the absence of electrical connection cannot be ascertained until the fuel injection device is in operation.

OBJECT AND SUMMARY OF THE INVENTION

The fuel injection device according to the invention has the advantage over the prior art that reliable and secure electrical connections of the fuel injection valve takes place in a simple way.

An especially advantageous feature is that a visible guide bolt makes it possible to check for completion for insertion of the plug elements of the fuel injection valve into the receptacles of the plug housing by simple visual checking. Moreover, a plug-in-type embodiment of the guide bolt enables simple, economical retrofitting of conventional fuel injection valves.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
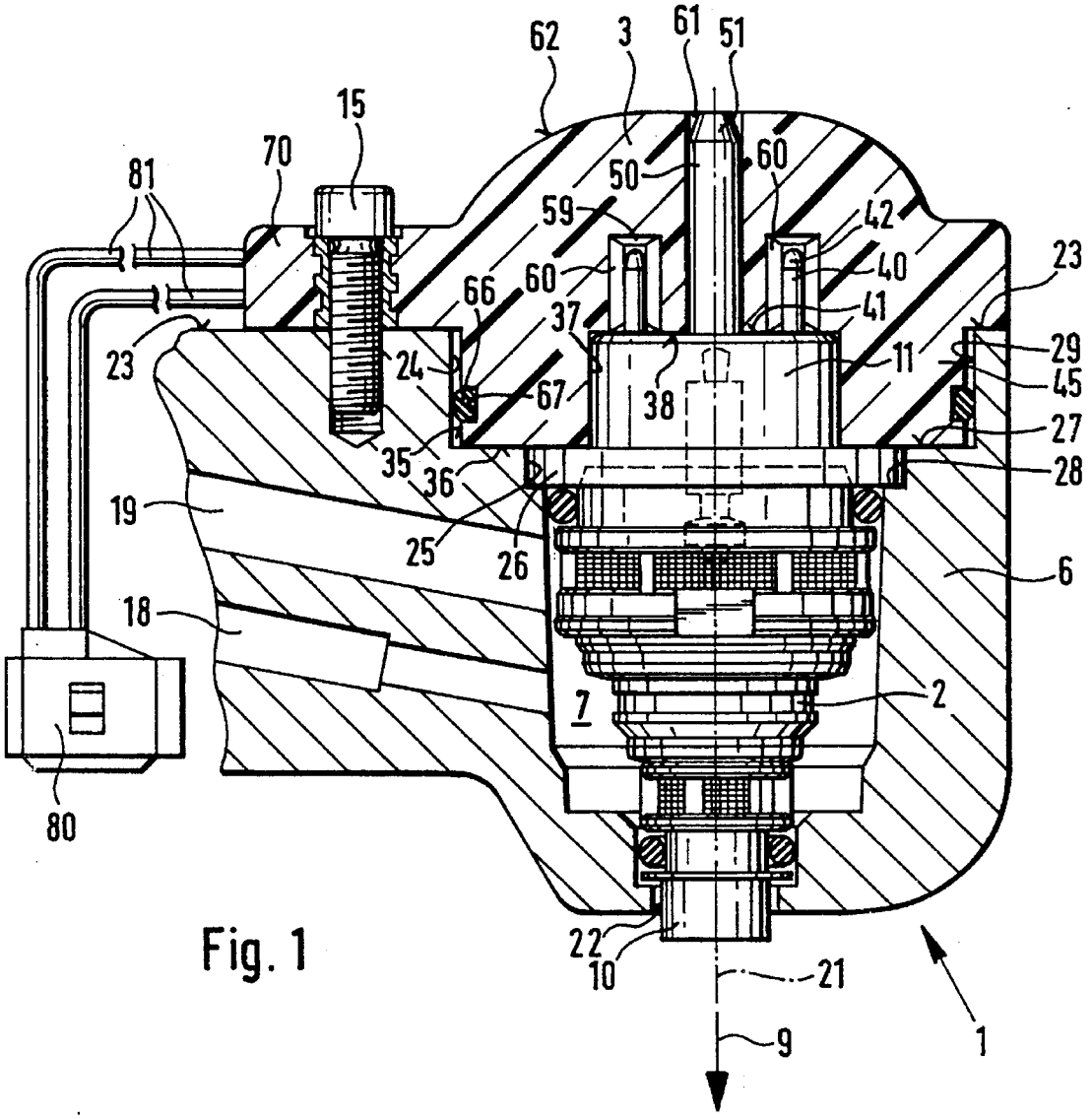
FIG. 1 shows a fuel injection device of a first exemplary embodiment of the invention in a sectional view.

FIG. 1 shows a fuel injection device 1 according to the invention in section; it has an electromagnetically actuatable fuel injection valve 2, which is introduced into a through opening 7 of a receiving stub 6. The receiving stub 6 is part of a central injection unit, for instance, in which the fuel injection valve 2 injects the fuel intermittently at a central point from an injection orifice, in the direction of the arrow 9 shown in FIGS. 1 and 2, above a throttle valve, not shown, into an intake tube of an internal combustion engine. For contacting the fuel injection valve 2, a ring-shaped plug housing 3 is used, which by way of example, after insertion of the fuel injection valve 2 into the through opening 7 of the receiving neck 6, is mounted on a valve housing end 11, located upstream of the injection orifice 10, of the fuel injection valve 2, or which by way of example is mounted before the insertion of the fuel injection valve 2, so that it can be inserted into the receiving neck 6 together with the fuel injection valve 2. To provide unambiguous reception of the valve housing end 11 in a recess 37 of the plug housing 3 in such a way as to preclude mistakes, the valve housing end 11 has an asymmetrical shape, for instance, which makes it possible for the valve housing end 11, in a suitably embodied shape of recess 37, to be inserted into the recess 37 only at a certain rotational position, so that radial positional fixation of the fuel injection valve 2 takes place. The plug housing 3 is made of electrically insulating material, such as plastic.

For supplying fuel and regulating the pressure of the fuel injection valve 2, two fuel conduits 18, 19 are used, for example, which penetrate the receiving stub 6 crosswise to a longitudinal axis 21 of the fuel injection valve 2 and lead into the through opening 7 of the fuel injection valve 2. By way of the fuel conduit 18, the fuel is introduced into the through opening 7 for supplying fuel to the fuel injection valve 2, and via the fuel conduit 19, which leads to a pressure control valve not shown in further detail, some of the fuel is removed again.

For receiving the fuel injection valve 2 and for receiving the plug housing 3, the through opening 7 has changing cross sections, which decrease in stages beginning at a surface 23 of the receiving stub 6 and proceeding to an injection port 22, from which the fuel injection valve 2 with its injection orifice protrudes. The through opening 7 has a first cylindrical opening portion 24, which extends axially from the surface 23 and forms an annular bearing face 27, on which the plug housing 3, provided with a tubular extension 45, rests with an annular end face 36. This is adjoined, beginning at the first opening portion 24 with the annular bearing face 27, in the axial direction by a second cylindrical opening portion 24, which has a smaller diameter than the first opening portion 24 and has an annular second bearing face 28, so as to receive the fuel injection valve 2 insertably with an annular collar 26 that rests on the bearing face 28; the axial length of the first opening portion 24 and second opening portion 25 is selected such that the fuel injection valve 2 with the valve housing end 11 is introduced all the way, for instance with an end face 41 of the valve housing end 11 aligned approximately with the surface 23 of the receiving stub 6.

For electrical contacting of the fuel injection valve 2, two plug elements 40 are provided, which protrude individually from the end face 41 of the valve housing end 11 and are offset parallel from the longitudinal axis 21 of the fuel injection valve 2. The plug elements are inserted into receptacles for receiving them. In a simple way, the plug elements 40 can be injection molded together with the valve housing end 11, which for instance is of plastic, and they have a cylindrical shape and a free, for instance rounded end 42. According to the invention, the fuel injection valve 2 has a guide bolt 50, which like the plug elements 40 protrudes from the end face 41 of the valve housing end 11 and extends centrally to the longitudinal axis 21 beyond the free ends 42 of the plug elements 40 with a free, for instance rounded end 51. For connecting the fuel injection valve 2, the plug housing 3 is set on top before or after insertion into the through opening 7 of the receiving stub 6; the plug housing 3 has receptacles 60 that correspond with the plug elements 40 of the fuel injection valve 2 and surround them, for instance, in order to form an electrically disconnectable connection. Other versions of the receptacles 60 are also possible for instance in the form of contact eyelets or round pin receptacles.

The recess 37 in the plug housing 3 is provided so as to receive the valve housing end 11; it extends upstream of the end face 36 into the plug housing 3 and has a bottom face 38, from which two openings 59 extend farther into the plug housing 37, for instance so as to receive the receptacles 60 in the form of round pin receptacles inside the openings 59. In a plastic injection molded embodiment of the plug housing 30, the receptacle 60, for instance embodied as contact eyelets, may simply be inserted into the plastic jointly as the plug housing 3 is made.

For insertion of the guide bolt 50, a guide opening 61 embodied centrally to the longitudinal axis 21 is provided; it extends from the bottom face 38 up to a caplike surface 62 of the plug housing 3. When the plug housing 3 is mounted on the valve housing end 11 or upon insertion of the valve housing end 11 of the plug housing 3, the guide bolt 50 is located with its free end 51 first in the recess 37 of the plug housing 3 and then is inserted into the guide opening 61; the plug elements 40, radially centered by the guide bolts 50, do not centrally reach the receptacles 60 until after the guide bolt 50 has been partially inserted into the guide opening 61, for instance to approximately half the axial length of the guide bolt 50. Tilting and bending of the plug elements 40 are thus precluded, and so reliable, secure, safe electrical contacting of the fuel injection valve 2 is assured. The axial length,of the guide opening 61 and guide bolt 50 should be selected such that the guide bolt 50 with its free end 51 extends to approximately the surface 62 of the plug housing 3 or protrudes from this surface 62, so that complete insertion of the plug elements 40 into the receptacles 60 can be checked by simple visual monitoring. In the exemplary embodiment of FIG. 1, the guide bolt 50 has an axial length that is approximately twice the axial length of the plug elements 40.

To seal off the plug housing 3, a sealing ring 66 is provided, which by way of example is placed in an annular groove 67, recessed out of an outer jacket face 35 of the tubular extension 45, of the plug housing 3 and rests on an inner jacket face 29 of the first opening 24. Retention of the fuel injection valve 2 and plug housing 3 is accomplished by way of a screw connection 15, for example, which connects an elongated extension 70 of the plug housing 3 with the receiving stub 6, the extension 70 being embodied integrally, transversely to the longitudinal axis 21, with the caplike plug housing 3. It is also possible for the plug housing 3 and fuel injection valve 2 to be secured to the receiving stub 6 by a detent or snap-type connection, for instance. Electrical connection of the receptacles 60 to a plug 80 is provided by connecting lines 81, which are fixed to the plastic of the plug housing 3 and are electrically connected to the receptacles 60.

Figure 2:
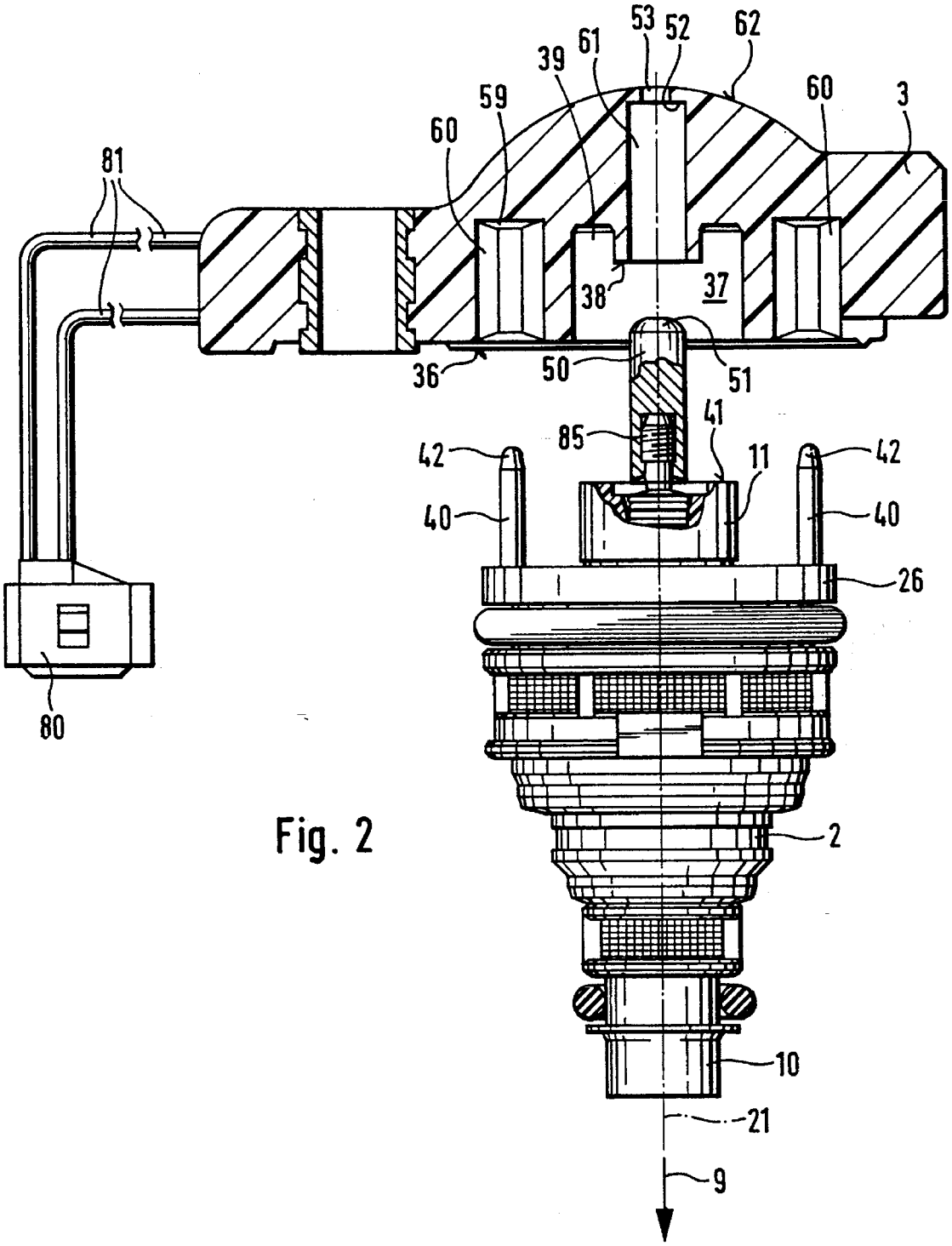
FIG. 2 is a sectional view of a second exemplary embodiment of the invention only partially assembled.

FIG. 2 shows a second exemplary embodiment of a fuel injection device according to the invention, in which elements that are the same or function the same are identified by the same reference numerals as in FIG. 1. For the sake of simplicity, no attempt was made to show the receiving stub 6 and the fuel injection valve 2 prior to installation, for instance before the mounting of the plug housing 3. Unlike the first exemplary embodiment of FIG. 1, here the receptacles 60 do not extend from the bottom face 38 of the recess 37 into the plug housing 3 but rather extend into the plug housing 3 from the end face 36 thereof, offset parallel from the longitudinal axis 21. The plug elements 40 of the fuel injection valve 2 of FIG. 2 are embodied in accordance with the receptacles 60; unlike the fuel injection valve 2 of FIG. 1, they extend axially outward, beginning at the annular collar 26 and offset parallel from the longitudinal axis 21, parallel with the valve housing end 11 and beyond the end face 41 of the second valve housing end 11.

Beginning at the end face 41 of the valve housing end 11, the guide bolt 50 extends past the free ends 42 of the plug elements 40 and is fixed into the plastic of the valve housing end 11, for example, or is mounted as an insertable plastic part onto an adjusting tang 85 of the fuel injection valve 2, so that existing conventional fuel injection valves can be retrofitted in a simple way. The guide bolt 50 has an axial length that is approximately twice the axial length of the plug elements 40. When the plug housing 3 is mounted onto the valve housing end 11, or upon insertion of the valve housing end 11 into the plug housing 3, the guide bolt 50 with the free end 51 is initially located in the recess 37 of the plug housing 3 and is then inserted into the guide opening 61; not until the guide bolt 50 has been inserted axially partway into the guide opening 61, or upon further joining together of the fuel injection valve 2 and plug housing 3, are the plug elements 40 axially precentered by the guide bolt 50, centrally enter the receptacle 60. Once the fuel injection valve 2 has been inserted all the way into the plug housing 3, the end face 41 of the valve housing end 11 rests on the bottom face 38 of the recess 37, being pressed slightly against it, and the valve housing end 11 is for instance located entirely within the recess 37; the guide bolt 50, with its free end 51, strikes a shoulder 52 of the guide opening 61, from which an opening 53, for example of smaller diameter than the guide opening 61, leads to the surface 62 of the plug housing 3. Through the opening 53, the electrical connection, for instance the complete insertion of the plug elements 40, can be checked by simple visual monitoring.

To improve the plug insertion, the bottom face 38 may for instance have an encompassing annular groove 39, which beginning at the bottom face 38 extends partway into the plug housing 3, so as to receive the air trapped when the valve housing end 11 is inserted into the recess 37.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection device having an electromagnetically actuatable fuel injection valve and a plug housing, wherein for electrical connection of the fuel injection valve, plug elements protruding from an end face of a valve housing end of the fuel injection valve are introduced into corresponding receptacles of the plug housing, the fuel injection valve (2) has a guide bolt (50), that protrudes from the end face (41) of the valve housing end (11), which bolt protrudes with its free end (51) past free ends (42) of the plug elements (40) and when the plug housing (3) and valve housing end (11) are put together is received in a corresponding guide opening (61) of the plug housing (3), before the plug elements (40) enter the receptacles (60), said guide opening (61) extends as far as a surface (62) of the plug housing (3) and the guide bolt protrudes from surface (62) of the plug housing (3).

2. A fuel injection device having an electromagnetically actuatable fuel injection valve and a plug housing, wherein for electrical connection of the fuel injection valve, plug elements protruding from an end face of a valve housing end of the fuel injection valve are introduced into corresponding receptacles of the plug housing, the fuel injection valve (2) has a plastic guide bolt (50), that protrudes from the end face (41) of the valve housing end (11) and is joined in a plugable fashion to the fuel injection valve (2), said guide bolt protrudes with its free end (51) past free ends (42) of the plug elements (40) and when the plug housing (3) and valve housing end (11) are put together is received in a corresponding guide opening (61) of the plug housing (3), before the plug elements (40) enter the receptacles (60).

3. A fuel injection device having an electro-magnetically actuatable fuel injection valve and a plug housing, wherein for electrical connection of the fuel injection valve, plug elements (40) protruding from an end face of a valve housing end of the fuel injection valve are introduced into corresponding receptacles (60) of the plug housing, the fuel injection valve (2) has a guide bolt (50) which is disposed centrally to a longitudinal axis (21) of the fuel injection valve, said guide bolt protrudes from the end face (41) of the valve housing end (11), which bolt protrudes with its free end (51) past free ends (42) of the plug elements (40) and when the plug housing (3) and valve housing end (11) are put together is received in a corresponding guide opening (61) of the plug housing (3), before the plug elements (40) enter the receptacles (60).

4. A fuel injection device as defined by claim 3, in which the guide bolt (50) has an axial length that is approximately twice the axial length of the plug elements (40).

5. A fuel injection device as defined by claim 3, in which the guide bolt (50) is embodied as a plastic part.

6. A fuel injection device as defined by claim 4, in which the guide bolt (50) is embodied as a plastic part.

7. A fuel injection device as defined by claim 3, in which the receptacles (60) extend into the plug housing (3) from one end face (36) of the plug housing (3).

8. A fuel injection device as defined by claim 4, in which the receptacles (60) extend into the plug housing (3) from one end face (36) of the plug housing (3).

9. A fuel injection device as defined by claim 3, in which the receptacles (60) extend into the plug housing (3), beginning at a bottom face (38) of a recess (37) of the plug housing (3).

10. A fuel injection device as defined by claim 4, in which the receptacles (60) extend into the plug housing (3), beginning at a bottom face (38) of a recess (37) of the plug housing (3).

11. A fuel injection device as defined by claim 5, in which the receptacles (60) extend into the plug housing (3), beginning at a bottom face (38) of a recess (37) of the plug housing (3).

12. A fuel injection device as defined by claim 3, in which the plug elements are offset parallel from a longitudinal axis (21) of the fuel injection valve (2).

* * * * *